United States Patent [19]

Gimple et al.

[11] Patent Number: 4,613,082

[45] Date of Patent: Sep. 23, 1986

[54] ELECTROSTATIC SPRAYING APPARATUS FOR ROBOT MOUNTING

[75] Inventors: James J. Gimple, Oregon; Charles T. Lasley, Toledo, both of Ohio

[73] Assignee: Champion Spark Plug Company, Toledo, Ohio

[21] Appl. No.: 628,397

[22] Filed: Jul. 6, 1984

[51] Int. Cl.[4] ..... B05B 5/02

[52] U.S. Cl. ..... 239/690; 239/600; 901/43

[58] Field of Search ..... 239/587, 600, 690; 901/43, 37; 414/4; 403/378, 379, 4

[56] References Cited

U.S. PATENT DOCUMENTS

| | | | |
|---|---|---|---|
| 2,865,662 | 12/1958 | Nurmse | 403/378 |
| 3,759,563 | 9/1973 | Kitamura | 414/4 |
| 4,218,166 | 8/1980 | Abu-Akeel et al. | 901/43 |
| 4,478,370 | 10/1984 | Hastings | 239/600 |
| 4,498,414 | 2/1985 | Kiba et al. | 901/43 |

FOREIGN PATENT DOCUMENTS

| | | | |
|---|---|---|---|
| 1372763 | 11/1974 | United Kingdom | 239/600 |

*Primary Examiner*—Joseph F. Peters, Jr.
*Assistant Examiner*—Scott Malpede
*Attorney, Agent, or Firm*—Emch, Schaffer, Schaub & Porcello Co.

[57] ABSTRACT

An improved electrostatic spraying apparatus for robot mounting is disclosed. The electrostatic spraying apparatus has a drive assembly connected to a spray gun assembly. The spray gun assembly has a base and a detachable barrel. The drive assembly acts to rotate the spray gun assembly through a plurality of preselected paths of movement. In addition, all coating contaminated parts can be removed from the apparatus by removing the detachable barrel.

7 Claims, 7 Drawing Figures

ELECTROSTATIC SPRAYING APPARATUS FOR ROBOT MOUNTING

Electrostatic spraying apparatus are often used in conjunction with computer programmed robots. A particularly important area where such equipment is being used is the electrostatic spray painting industry. The variety of sizes and shapes of articles which can now be painted by robot controlled electrostatic spraying equipment has greatly increased due to the increased mobility and programmability of the robots. Unfortunately, maximum utilization of this equipment has often been limited by the bulkiness and lack of mobility of the electrostatic spraying equipment. Part of the bulkiness of electrostatic spraying equipment in the past was due to the number of supply lines needed to operate the equipment. Typically an electrostatic spray gun will have a coating supply line, an electrical power supply line and three pressurized air lines all connected to the spray gun. Many of these supply lines are in close proximity to the spray gun nozzle. This limits the actual movement of the gun and the size of the areas into which the gun can be projected.

It is therefore an object of the present invention to provide an electrostatic spraying apparatus with a portion of the supply lines remotely attached to the apparatus to increase the mobility and streamline the apparatus.

It is another object of the present invention to provide an electrostatic spraying apparatus which is itself capable of moving through a plurality of predetermined paths of movement thereby increasing the overall mobility of the apparatus.

Another problem with many prior electrostatic spraying apparatus involves contamination of various components of the apparatus with the coating material. This is particularly true during a color change. Usually when a color change is desired, the entire apparatus must be flushed out or removed from the end of a robot arm because of paint contamination. It is therefore a further object of the present invention to provide a spraying apparatus with easily separable component parts so that all coating contaminated parts of the gun can be quickly removed, cleaned and replaced.

Other objects and advantages of the present invention will become apparent from a review of the following specification, drawings and claims.

SUMMARY OF THE INVENTION

The present invention relates to an electrostatic spraying apparatus which has a plurality of predetermined paths of movement and is capable of being mounted on a robot arm. The invention includes a drive assembly for mounting on a robot arm. A spray gun base is rotatably connected to the drive assembly and the drive assembly rotates the spray gun base through first and second paths of movement. Selection means are provided for predeterminately selecting one or the other of the first and second paths of movement. A spray gun with a coating supply line is detachably mounted to the spray gun base. Securement means are provided for securing the spray gun to the base and removal of the securement means allows removal of all coating contaminated parts from the spraying apparatus. An electrical power supply line is positioned in the spray gun base and is in communication with the spray gun. Air supply lines are positioned in the drive assembly and are in communication with the spray gun and base. With this configuration, the air supply lines remain stationary relative to the drive assembly when the spray gun and base are rotated by the drive assembly.

DESCRIPTION OF THE PREFERRED EMBODIMENT

Figure 1:
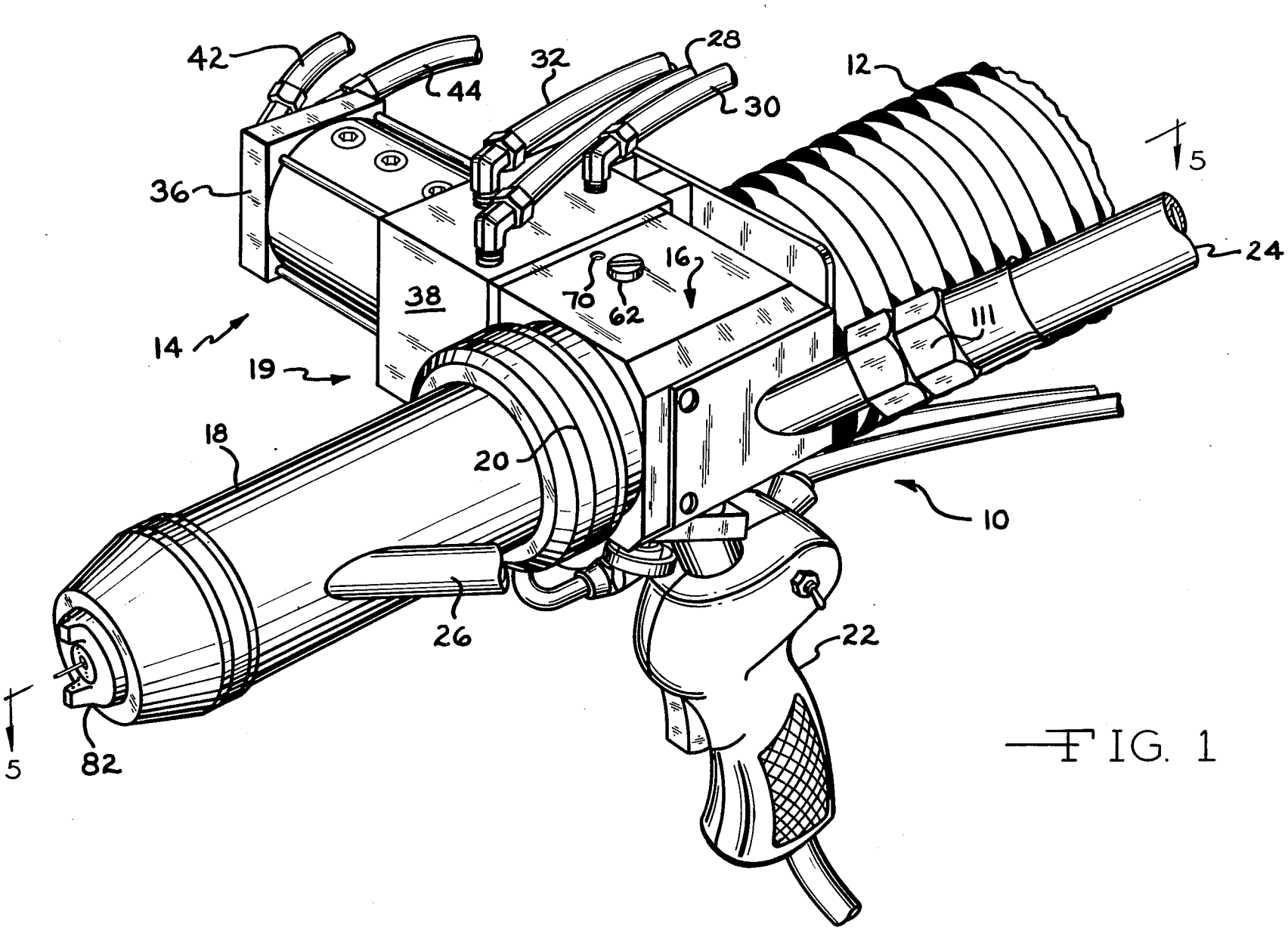
FIG. 1 is a perspective view of a spraying apparatus, according to the present invention, with a teaching handle attached.
Figure 2:
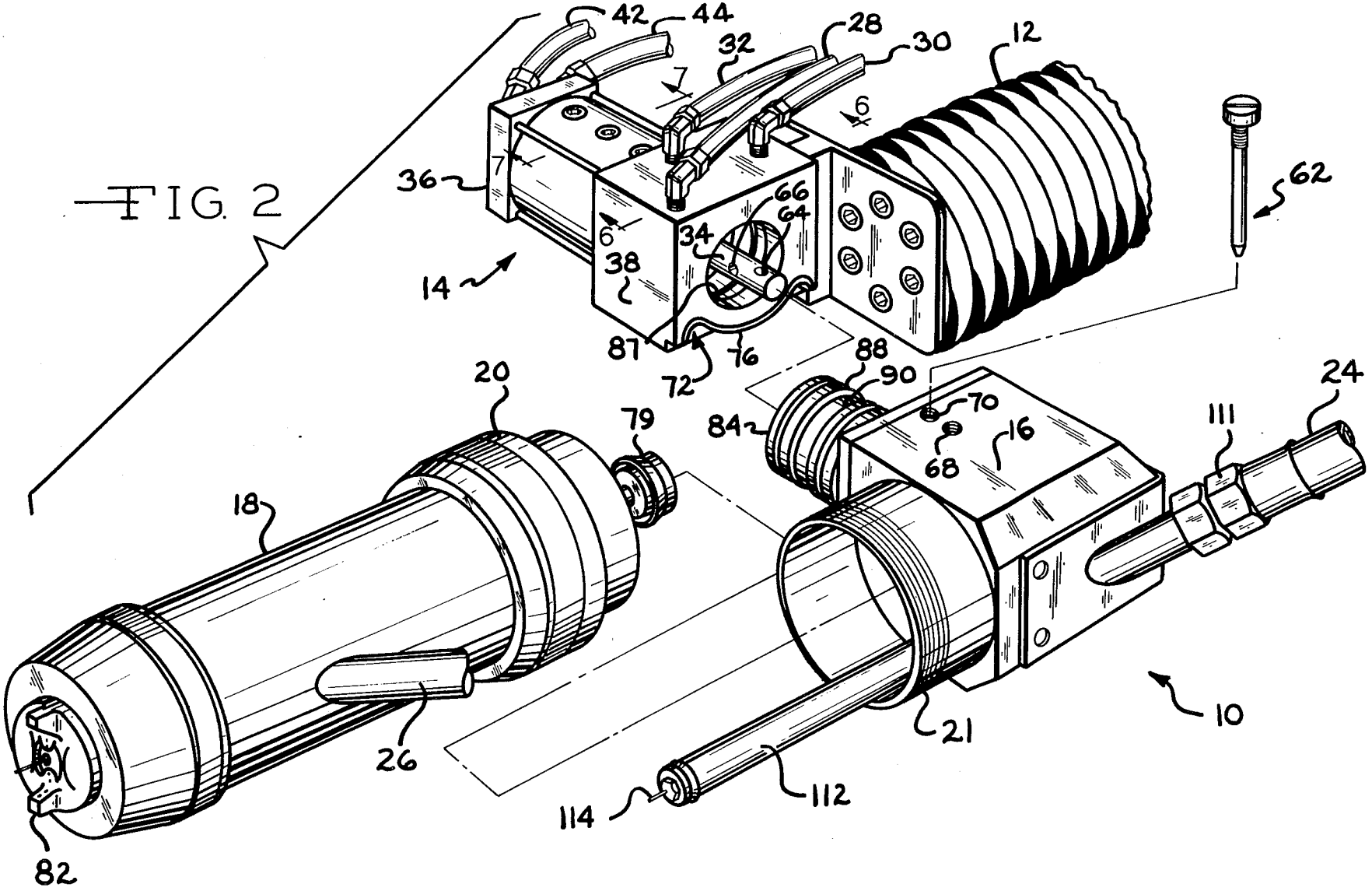
FIG. 2 is an exploded perspective view of the spraying apparatus shown in FIG. 1.

The present invention relates to an electrostatic spraying apparatus which may be mounted on an industrial robot for remote controlled spraying applications. An embodiment of an electrostatic spraying apparatus 10, according to the present invention, is shown in FIG. 1. The electrostatic spraying apparatus 10 is shown mounted on a robot arm 12. The spraying apparatus 10 consists of three main parts, a drive assembly 14, a spray gun base 16 and a spray gun/barrel 18. The spray gun base 16 and the spray gun 18 are operatively connected to one another by securement means 20 to form a spray gun assembly 19 which is in turn rotated through either a first or a second path of movement by the drive assembly 14. In FIG. 2, the securement means 20 is an annular threaded retainer ring which threadingly engages a threaded annular receptacle or sleeve 21 on the base 16. The base of the spray gun 18 fits down into the receptacle 21 and the retainer ring 20 is then screwed onto the receptacle 21 to hold the gun 18 in place.

In FIG. 1, the apparatus 10 is equipped with a teaching handle 22 which is used for initial programming of the robot. Once the programming is complete, the handle 22 is removed and is not used during normal operation.

Electrical power for the apparatus 10 is supplied through an electrical supply line 24 located in the spray gun base 16. The spraying liquid is fed to the apparatus 10 through a coating supply line 26 located in the spray gun barrel 18. The spraying liquid in the present embodiment is paint but other conductive substances may be used with the present invention including sprayable solids. Air for the spray gun is supplied through air lines 28, 30 and 32.

The range of movement of the spray apparatus 10 is primarily determined by the flexibility of the robot arm 12 and the amount of space needed for the air, paint and voltage supply lines. With the present invention, the mobility of the apparatus 10 has been increased by allowing it to rotate through predetermined first or second paths of movement relative to the robot arm 12 and by placing the air lines 28, 30 and 32 at a position remote from the spray gun 18 and the base 16. As a result, the apparatus 10 is more compact and mobile thus yielding a more versatile spraying apparatus.

Referring to FIG. 2, the spray gun assembly 19, consisting of the spray gun 18 and the base 16, is driven by a drive shaft 34 of the drive assembly 14. The drive assembly 14 consists of an air actuated rotor 36 and an air manifold 38. The air rotor 36 drives the drive shaft 34 which is operatively connected to and drives the spray gun base 16 and the spray gun 18. The air manifold 38 channels the incoming air of the air lines 28, 30 and 32 into the appropriate areas of the spray gun 18 via the spray gun base 16. In so doing, the air lines 28, 30 and 32 remain stationary and remote relative to the spray gun 18 thus making the apparatus 10 more compact.

Figure 7:
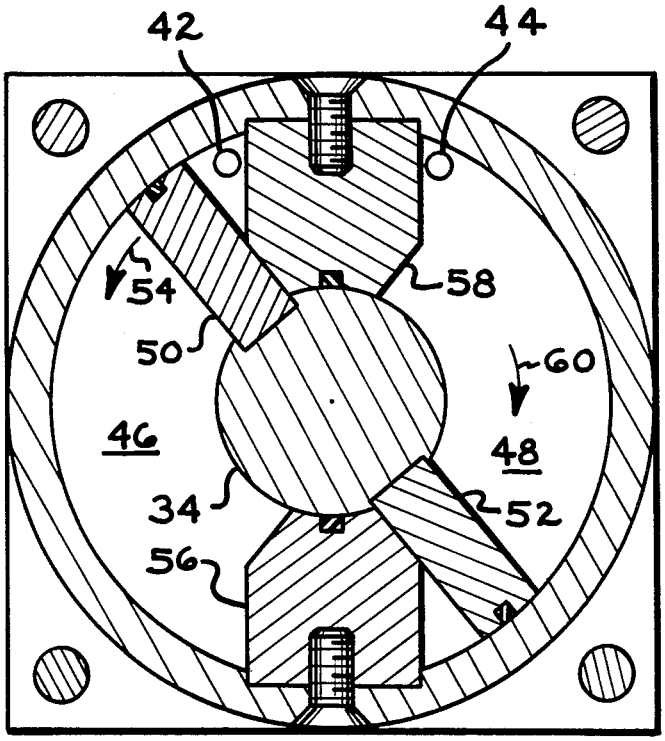
FIG. 7 is a cross-sectional view of an air rotor of a spraying apparatus, according to the present invention, taken along line 7—7 of FIG. 2.

The air rotor 36 is a modified version of a pneumatic torque actuator manfactured by the Roto Actuator Corporation. Air for driving the rotor 36 is supplied through air lines 42 and 44. As can be seen in FIGS. 2 and 7, the interior of the rotor 36 consists of two chambers 46 and 48. The air line 42 suppies air to the chamber 46 and the air line 44 supplies air to the chamber 48. Connected to the drive shaft 34 are a pair of opposed vanes 50 and 52. When air is fed into the chamber 46 via the air line 42, the pressure increases causing the vane 50 to move in the direction of the arrow 54 and the drive shaft 34 to rotate in the counterclockwise direction. Rotation of the shaft 34 will continue until the vane 50 abuts a stop plate 56 and the vane 52 abuts a stop plate 58. To reverse the rotation of the drive shaft 34, the pressure is released in the line 42 and, instead, the line 44 is pressurized. As the pressure increases, the vane 52 moves in the direction of the arrow 60 which causes the drive shaft 34 to rotate in the opposite or clockwise direction. The overall amount of rotation in one direction is governed by the angle between the stop plates 56 and 58. In FIG. 7, the rotor 36 is capable of rotation through an angle of approximately 100°.

Referring to FIG. 2, the drive shaft 34 of the rotor 36 passes through the air manifold 38 and into the spray gun base 16. The spray gun base 16 is operatively connected to the drive shaft 34 by selection means 62 which allows the preselection of either the first or the second path of movement of the spray gun 18 and the base 16. In FIG. 2 the selection means is a locator pin 62 which extends through base 16 and into drive shaft 34.

The drive shaft 34 has a first hole 64 and a second hole 66 located in its distal end. The first hole 64 and the second hole 66 are perpendicular to one another and are adapted to receive the locator pin 62. The spray gun base 16 has a corresponding first locator hole 68 and a second locator hole 70, which are in vertical alignment with first hole 64 and the second hole 66 respectively. When the drive shaft 34 and the spray gun base 16 are in the positions shown in FIG. 2, the axes of the first hole 64 and the first locator hole 68 are in alignment. By inserting the locator pin 62 into the first locator hole 68 and through the first hole 64 in the drive shaft 34, the spray gun base 16 is rotatably secured to the drive assembly 14. With the locator pin 62 in this position, the drive assembly 14 can rotate the spray gun 18 from the horizontal position to the vertical up position and back to the horizontal position. This is the first path of movement.

To effect rotation between the horizontal position and the vertical down position, the locator pin 62 is removed from the first locator hole 68. The spray gun base 16 is then rotated to the vertical down position which brings the second hole 66 in the drive shaft 34 in alignment with the second locator hole 70 in the base 16. The locator pin 62 is then placed into the second locator hole 70 and through the second hole 66, thereby rotatably resecuring the spray gun 18 and the base 16 to the drive assembly 14. With the locator pin 62 in this position, the drive assembly 14 can rotate the spry gun 18 between the horizontal position and the vertical down position. This is the second path of movement.

To prevent the spray gun base 16 and the gun 18 from traveling beyond the vertical up and vertical down positions in the first and second paths of movement, a stop means consisting of a grooved track 72 (FIGS. 2 and 6) and a stop member 74 (FIG. 3) are used to limit the overall movement of the spray gun 18 and the base 16. The grooved track 72 is located in the base of the air manifold 38. The track 72 has a metal insert 76 which is held in place by a screw 78 or by other suitable means (See FIG. 6). When the insert 76 becomes worn, it is removed and replaced with a new insert, thus avoiding the necessity of replacing the entire manifold 38.

Figure 3:
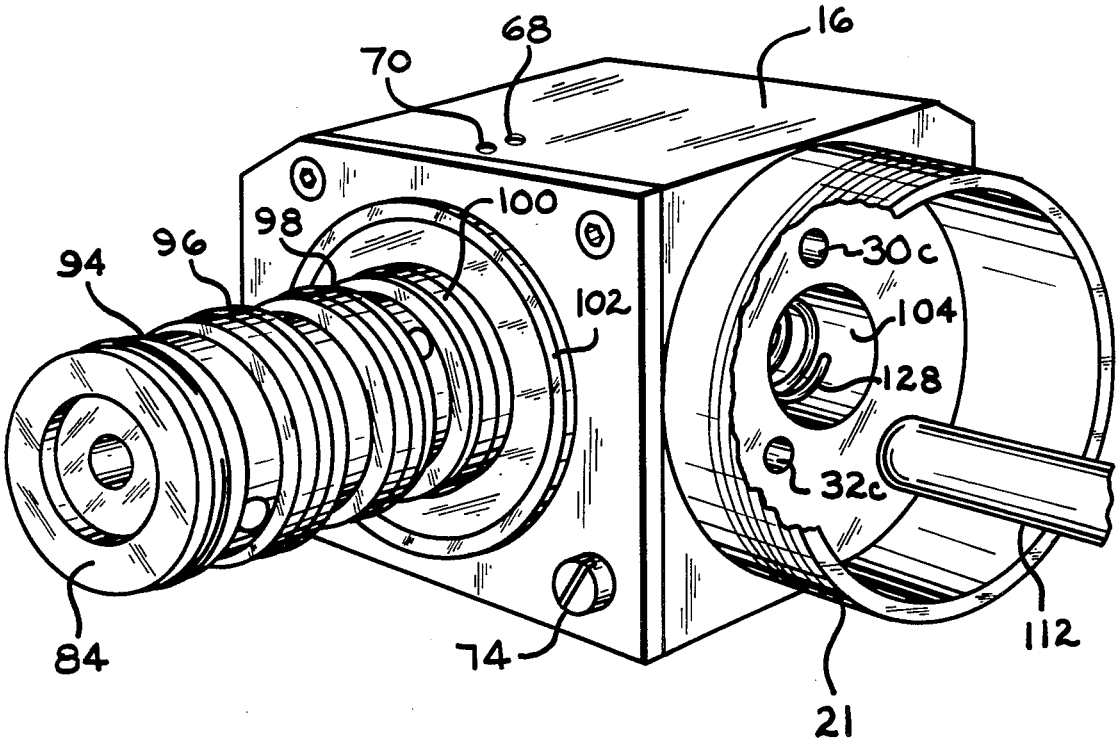
FIG. 3 is a perspective view of a spray gun base of the spraying apparatus, according to the present invention.

Turning to FIG. 3, a mating stop member 74, which in this figure is a large headed screw, is located in the side of the base 16 adjacent the air manifold 38. When the drive assembly 14 and the spray gun base 16 are secured by locator pin 62, the stop member 74 in base 16 matingly engages the grooved track 72 in air manifold 38. When the air rotor 36 is actuated, the spray gun 18 and base 16 will rotate until the stop member 74 reaches either end of the grooved track 72, at which time any further advancement of the spray gun 18 in that particular direction is prohibited. Thus, the stop meams which consists of the grooved track 72 and stop member 74, physically prohibits the spray gun 18 and base 16 from traveling beyond the vertical in either the up or down position.

As shown in FIG. 3, the stop member 74 is located in the lower right hand corner of the base 16. This is the proper location for the stop member 74 when the locator pin 62 is in the second locator hole 70 which corresponds to the second path of movement between the horizontal and the vertical down position. With the stop member 74 in this position, the spray gun 18 cannot move above the horizontal or past the vertical down position.

When it is desired to operate the spray gun 18 in the first path of movement, both the locator pin 62 and the stop member 74 must be changed. First, locator pin 62 is removed from second locator hole 70 and base 16 is separated from air manifold 38. Next, stop member 74 is removed from the lower right hand corner of base 16 as shown in FIG. 3. Stop member 74 is repositioned into a corresponding threaded hole (not shown) in the lower left hand corner of base 16 as viewed from FIG. 3. The base 16 is then slid over shaft 34 until the first hole 64 in the shaft 34 aligns with the first locator hole 68 in the base 16. The locator pin 62 is reinserted into the first locator hole 68 and through the first hole 64, thus resecuring the base 16 to the manifold 38. In this position, the grooved track 72 and the stop member 74 prohibit the spray gun 18 from moving below the horizontal or past the vertical up position. Thus, through the use of selection means 62, the apparatus 10 is capable of traveling through either one of two preselected paths of movement. This increases the overall mobility of apparatus 10.

The present invention also yields an apparatus 10 that is more compact due to the location of the air supply lines 28, 30 and 32 at a position remote from the actual spray gun base 16 and the gun 18. Often, these lines are connected directly to the spray gun which increases the space needed and therefore reduces the number of areas where a spraying apparatus can be used effectively.

Figure 5:
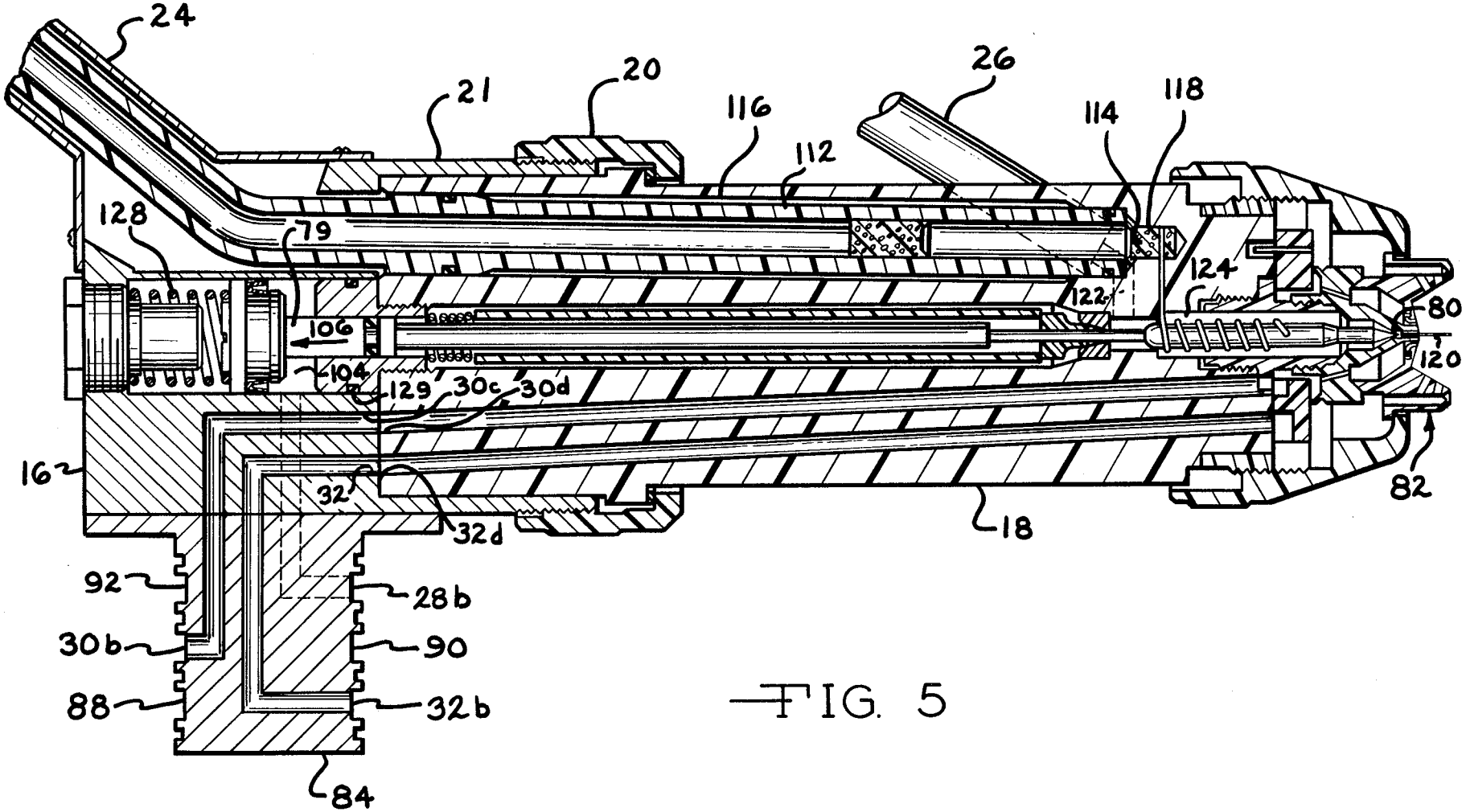
FIG. 5 is a cross-sectional view of a spraying apparatus, according to the present invention, taken along line 5—5 of FIG. 1.

Referring to FIGS. 2 and 5, incoming air for the gun 18 is supplied through lines the 28, 30 and 32 which are operatively connected to the air manifold 38. The air line 28 supplies air for a fluid needle actuating piston 79 which actuates a fluid needle control valve 80. The valve 80 controls the flow of paint or other suitable coating material during coating applications. The air line 30 supplies the air needed to atomize the coating material into small particles as it leaves the spray nozzle 82. The air line 32 supplies the air for shaping the pattern of the coating material as it leaves the spray nozzle 82.

The air manifold 38 is used in conjunction with a channeled sleeve 84 on the base 16 to provide a series of air channels or passageways between the manifold 38 and the spray nozzle 82. In so doing, the air lines 28, 30 and 32 are kept remote from the spray gun 18 while a rotatable air tight connection is maintained between the stationary manifold 38 and the spray gun base 16.

Figure 6:
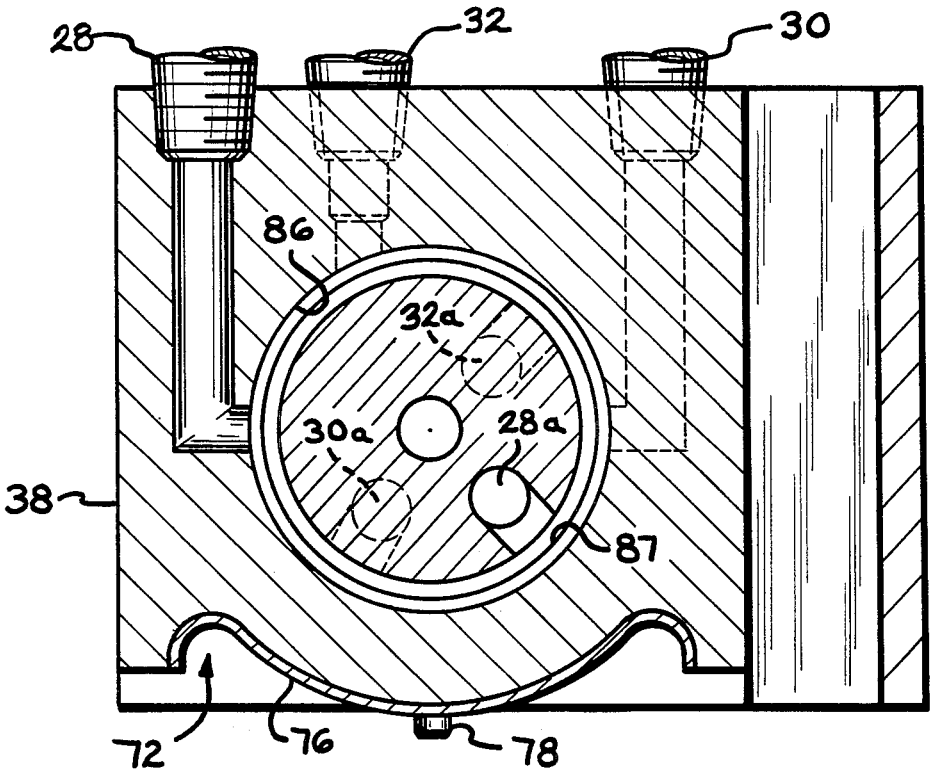
FIG. 6 is a cross-sectional view of an air manifold of a spraying apparatus, according to the present invention, taken along line 6—6 of FIG. 2.

Referring to FIG. 6, the air lines 28, 30, and 32 all lead into the interior of the air manifold 38 communicating with annular grooves defined in the wall 86 of manifold 38. Referring to FIGS. 3 and 5, the sleeve 84 of the base 16 has three holes 28*a*, 30*a*, and 32*a* communicating with holes 28*b*, 30*b*, and 32*b* respectively which communicate with annular grooves 92, 90, and 88 in sleeve 84. Each of the annular grooves 92, 90, and 88 are separated by "O" rings 94, 96, 98 and 100 which form rotatable air tight seals. In addition, a face seal 102 (See FIG. 3) is located on the surface of the base 16 to ensure an air tight seal between the manifold 38 and base 16. As a result, incoming air is transferred from the air manifold 38 to the spray gun base 16 in a manner which maintains an air tight seal during rotation of these two parts.

Referring to FIG. 5, piston air entering the hole 28*b* in the sleeve 84 travels through an interior channel in the base 16 until it reaches a piston chamber 104. When the piston chamber 104 is pressurized, the piston 79 moves in the direction of arrow 106 which in turn opens the needle valve 80 and permits coating material to flow from the spray nozzle 82.

Referring again to FIG. 5, atomization air enters the base 16 through the hole 30*b* and exits base 16 through the hole 30*c* (See FIG. 3). The hole 30*c* is in communication with a hole 30*d* in the end of spray gun barrel 18 (See FIG. 4). A seal 108 is positioned around the hole 30*d* to provide an air tight interface between the holes 30*c* and 30*d*. Thus the atomization air enters the spray gun base 16 through the hole 30*b*, travels through the communicating air channel in the base 16 and up the spray gun barrel 18 until it emerges from the spray nozzle 82 to atomize the coating material exiting needle valve 80.

In a similar fashion, the shaping air enters the base 16 through the hole 32*b* and exits the base 16 through a hole 32*c*. The hole 32*c* is in turn aligned with a hole 32*d* in the end of the spray gun barrel 18. A seal 110 provides an air tight interface between the holes 32*c* and 32*d*. Thus, the shaping air enters base 16 through hole 32*b*, travels through the base 16 and up the spray gun barrel 18 until it emerges from the spray nozzle 82 and acts to shape the pattern of the atomized coating material.

Figure 4:
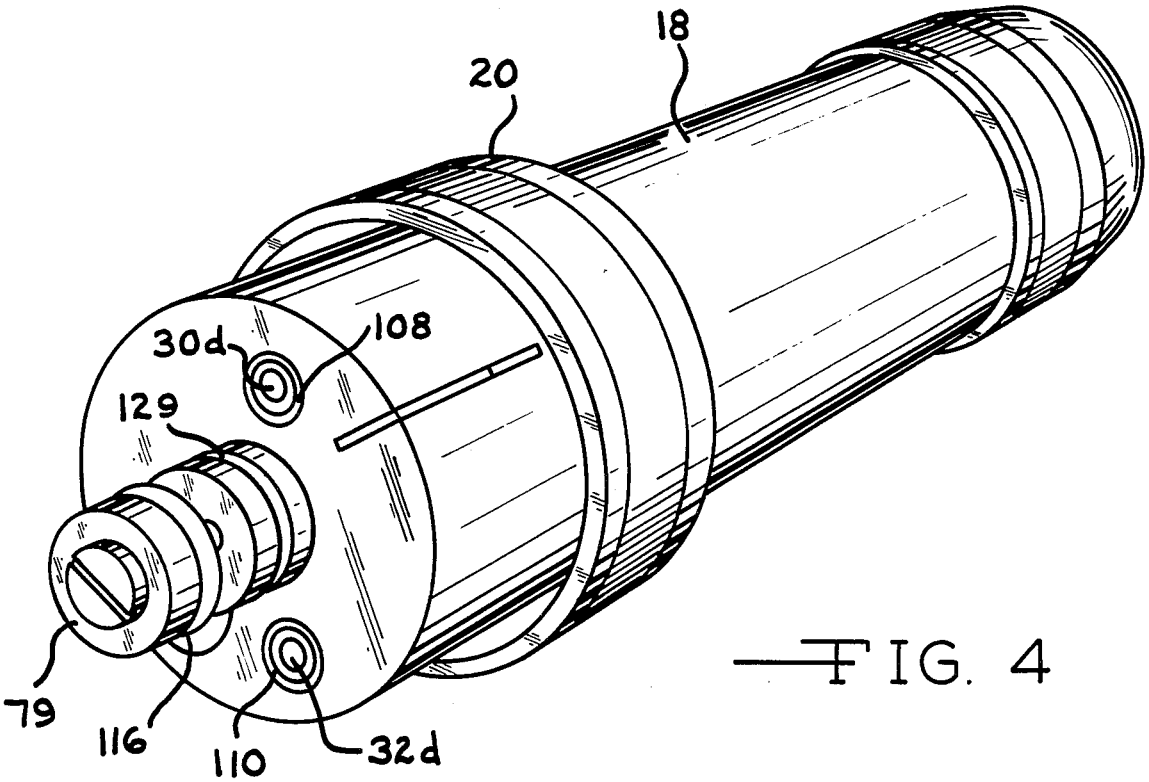
FIG. 4 is a perspective view of the spray gun body of a spraying apparatus, according to the present invention.

Voltage for the apparatus 10 is delivered through electrical supply line 24 which has a quick release coupling 111 located on the side of spray gun base 16 (See FIG. 2). The supply line 24 exits base 16 encased in a nonconductive conduit 112 having a conductive lead 114 protruding from the end of conduit 112. Referring to FIGS. 4 and 5, the spray gun 18 has a bore 116 which is adapted to receive the conduit 112. At the end of bore 116 is conductive foam 118. The rear end of an electrostatic needle 120 is embedded within the conductive foam 118 as can be seen in FIG. 5.

When the spray gun 18 is attached to the base 16, the conduit 112 is inserted within the bore 116 in the spray gun 18. As the securement ring 20 is tightened onto the base 16, the conductive lead 114 embeds itself in the conductive foam 118 completing the voltage communication to the electrostatic needle 120.

Coating material, which in the present embodiment is paint, is supplied to the spray gun 18 through the supply line 26. The paint travels through an interior passageway 122 to a chamber 124, which lies directly behind the needle valve 80 and surrounds the needle 120. To release the paint, the piston chamber 104 is pressurized via air line 28. Once sufficient air pressure exists in chamber 104, the piston 79 overcomes the spring force of compression spring 128 and the piston 79 moves in the direction of the arrow 106. The piston 79 is operatively connected to needle 120. When the piston 79 moves in the direction of the arrow 106, the needle 120 retracts and allows paint to flow from the spray nozzle 82. As the paint emerges, it is atomized by air supplied by the air line 130, shaped by air supplied by the air line 32 and electrically charged by the needle 120. Because the air lines 28, 30 and 32 are separately controllable, both the degree of atomization and the amount of shaping can be individually controlled.

Once a spraying operation is completed or a color change is desired, removal of the paint contaminated parts becomes easy due to the design of the present apparatus. Because of the location of the paint supply 26, the only portion of the apparatus 10 that is contaminated with paint is the spray gun 18. Secondly, the only moving part of spray gun 18 which must be interfaced with the base 16 is the piston 79 which is recessed in the chamber 104 until it abuts the compression spring 128. Once in place, the chamber 104 is kept air tight by way of the seal 129 positioned about the base of spray gun 18. To remove the gun 18 from the base 16, the operator simply unscrews the retainer ring 20 and pulls the gun 18 off its base 16. The gun 18 can then either be cleaned or a new gun 18 inserted in its place. If the operator wishes to remove or replace both the gun 18 and the base 16, he simply removes the locator pin 62 and separates the base 16 from the air manifold 38.

From the foregoing, it thus becomes apparent that the present invention yields a compact, streamlined spraying apparatus for robot mounting with increased mobility. With the present invention the spraying apparatus is capable of two paths of movement which can be used to supplement the movements of the robot. In addition, the air supply lines have been positioned at a point remote from the gun itself, thus making the gun more compact and allowing its use in more confined areas. Finally, because of the present invention's design, removal and- /or replacement of the entire apparatus or any component part thereof is quickly and easily accomplished.

Having thus described the present invention in detail and with reference to the accompanying drawings, it should be understood that various modifications and changes may be made in the invention without departing from the scope and content of the following claims.

We claim:

1. An electrostatic spraying apparatus, for robot mounting, comprising, in combination, a drive assembly for mounting on a robot arm, a spray gun base rotatably connected to said drive assembly, said drive assembly including a rotor and a drive shaft extending through a manifold and connected to said gun base, said manifold disposed between said rotor and said gun base, said drive assembly rotating said spray gun base through first and second paths of movement, selection means for predeterminately selecting said first and second paths of movement, a spray gun detachably mounted to said spray gun base, a coating supply line connected to said spray gun, securement means for securing said spray gun to said spray gun base, whereby said securement means allows removal of all coating contaminated parts from said spraying apparatus, a voltage supply line positioned in said spray gun base, a plurality of air supply lines operatively connected to said manifold, said supply lines being in communication with said spray gun, said air supply lines remaining stationary relative to said spray gun base when said spray gun and base are rotated by said drive assembly.

2. An electrostatic spraying apparatus according to claim 1, wherein said securement means for securing said spray gun to said spray gun base comprises a threaded retainer ring positioned about said spray gun which threadingly engages a threaded portion of said spray gun base adjacent said threaded retainer ring.

3. An electrostatic spraying apparatus according to claim 2, wherein said selection means further includes stop means for limiting the amount of rotation of said spray gun base through said first and second paths of movement.

4. An electrostatic spraying apparatus according to claim 3, wherein said stop means comprises a grooved track in either said drive assembly or said spray gun base and a stop member which extends from the other of said drive assembly or said spray gun base, said stop member being received by and traveling in said grooved track.

5. An electrostatic spraying apparatus according to claim 1, wherein said coating supply line supplies paint to said spray gun.

6. An electrostatic spraying apparatus, for robot mounting comprising:

a drive assembly for mounting on a robot arm, a spray gun base rotatably connected to said drive assembly, said drive assembly including an air actuated rotor and an air manifold disposed between said rotor and said gun base, said rotor having a drive shaft with a distal end for rotating said gun base, said distal end of said drive shaft extending through said manifold and into said gun base, a first and second hole extending through said distal end of said drive shaft, said second hole being perpendicular to said first hole, said drive assembly rotating said spray gun base through first and second paths of movement, selection means for predetermining selecting said first and second paths of movement, said selection means including a locator pin, a first and second locator hole extending into said spray gun base, said first and second locator holes being in vertical alignment with said first and second holes respectively in said distal end of said drive shaft, whereby positioning said locator pin in said first locator hole and through said first hole allows rotation of said spray gun base through said first path of movement and positioning said locator pin in said second locator hole and through said second hole allows rotation of said spray gun base through said second path of movement, a spray gun detachably mounted to said spray gun base, a paint supply line connected to said spray gun, securement means for securing said spray gun to said spray gun base, said securement means including a threaded retainer ring positioned about said spray gun which threadingly engages a threaded portion of said spray gun base adjacent said threaded sleeve, whereby said securement means allows removal of all paint contaminated parts from said spraying apparatus, a voltage supply line positioned in said spray gun base, a plurality of air supply lines operatively connected to said drive assembly, said supply lines being in communication with said spray gun, said air supply lines remaining stationary relative to said spray gun base when said spray gun and base are rotated by said drive assembly.

7. An electrostatic spraying apparatus, for robot mounting, comprising, in combination, a drive assembly for mounting on a robot arm, a spray gun base rotatably connected to such drive assembly, said drive assembly includes an air actuated rotor and an air manifold disposed between said rotor and said gun base, said rotor having a drive shaft with a distal end for rotating said gun base, said distal end of said drive shaft extending through said manifold and into said gun base, a first and second hole extending through said distal end of said drive shaft, said second hole being perpendicular to said first hole, said drive assembly rotating said spray gun base through first and second paths of movement, selection means for predeterminately selecting said first and second paths of movement, said selection means consisting of a locator pin, a first and second locator hole extending into said spray gun base, said first and second locator holes being in vertical alignment with said first and said second holes respectively in said distal end of said drive shaft, whereby positioning said locator pin in said first locator hole and through said first hole allows rotation of said spray gun and base through said first path of movement and positioning said locator pin in said second locator hole and through said second hole allows rotation of said spray gun and base through said second path of movement, a spray gun detachably mounted to said spray gun base, a coating supply line connected to said spray gun, securement means for securing said spray gun to said spray gun base, whereby said securement means allows removal of all coating contaminated parts from said spraying apparatus, a voltage supply line positioned in said spray gun base, a plurality of air supply lines operatively connected to said drive assembly, said supply lines being in communication with said spray gun, said air supply lines remaining stationary relative to said spray gun base when said spray gun and base are rotated by said drive assembly.

* * * * *